US005176261A

United States Patent [19]

Holz

[11] Patent Number: 5,176,261

[45] Date of Patent: Jan. 5, 1993

[54] ROTOR FOR PRESSURE SORTERS FOR SORTING FIBROUS SUSPENSIONS

[75] Inventor: Emil Holz, Eningen, Fed. Rep. of Germany

[73] Assignee: Hermann Finckh Maschinenfabrik GmbH & Co., Pfullingen, Fed. Rep. of Germany

[21] Appl. No.: 638,311

[22] Filed: Jan. 4, 1991

[30] Foreign Application Priority Data

Jan. 6, 1990 [DE] Fed. Rep. of Germany ..... 4000248

[51] Int. Cl.[5] ..... D21D 5/00; B07B 1/04

[52] U.S. Cl. ..... 209/273; 209/270; 209/300

[58] Field of Search ..... 209/273, 270, 306, 380; 162/55; 210/413, 415

[56] References Cited

U.S. PATENT DOCUMENTS

| | | | |
|---|---|---|---|
| 4,188,286 | 2/1980 | Holz | 209/273 |
| 4,200,537 | 4/1980 | Lamort | 209/273 X |
| 4,356,085 | 10/1982 | Schön et al. | 209/273 |
| 4,374,728 | 2/1983 | Gauld | 209/273 |
| 4,601,819 | 7/1986 | Pellhammer et al. | 209/273 |
| 4,836,915 | 6/1989 | Frejborg | 209/273 |
| 4,919,797 | 4/1990 | Chupta et al. | 209/273 |
| 5,000,842 | 3/1991 | Ljokkoi | 209/273 |

FOREIGN PATENT DOCUMENTS

| | | | |
|---|---|---|---|
| 2712715A1 | 9/1978 | Fed. Rep. of Germany . | |
| 2547605 | 5/1984 | France . | |
| 269070A3 | 6/1989 | German Democratic Rep. . | |
| 796283 | 1/1981 | U.S.S.R. | 209/273 |
| 622259 | 4/1949 | United Kingdom | 210/415 |

*Primary Examiner*—Donald T. Hajec
*Attorney, Agent, or Firm*—Leydig, Voit & Mayer

[57] ABSTRACT

Rotor for pressure sorters for sorting fibrous suspensions, comprising a plurality of cleaning vanes provided for the circulation on the inlet side of a screen cylinder of the pressure sorter, these vanes being designed in sections as return regions and in sections as supply regions; the return regions are designed such that they urge the fibrous suspension portions adjacent the screen inlet side away from the screen cylinder, whereupon these fibrous suspension portions are diverted by the supply regions of the cleaning vanes towards the screen inlet side and fed back to the latter.

19 Claims, 8 Drawing Sheets

ROTOR FOR PRESSURE SORTERS FOR SORTING FIBROUS SUSPENSIONS

BACKGROUND OF THE INVENTION

The invention relates to a rotor for pressure sorters for sorting fibrous suspensions, such as those described and illustrated, for example, in U.S. Pat. Nos. 3,581,903, 3,849,302 and 4,155,841 or in EP No. 0 042 742-B1. Pressure sorters of this type have a rotationally symmetrical screen, mostly in the form of a screen cylinder, to which the fibrous suspension to be sorted is fed in the direction of the rotor axis, whereby the inner or outer side of the screen can form the inlet or inflow side of the screen. Mostly, the screen is arranged with a vertically oriented axis and the fibrous suspension to be sorted is supplied to the screen from above so that the upper end of the screen forms its inlet end. The rotor of this pressure sorter has a rotor axis coinciding with the screen axis and its operative regions rotate adjacent the inlet side of the screen. If the usable fibrous suspension flows through the screen from the inside to the outside, the rotor is arranged in the interior of the screen cylinder. If the inlet side of the screen is on the outside, the rotor has extending from its axis, a carrier which overlaps the screen wall and to which the regions of the rotor passing the outer side of the screen are attached. The invention does, however, also relate to those pressure sorters, in which the kinematic ratios are exactly the reverse, i.e. in which a screen rotating about its axis and a stationary "rotor" are provided.

The rotor of such a pressure sorter has the object of preventing the screen apertures from becoming clogged by fiber conglomerates or by impurities contained in the fibrous suspension. For this purpose, the rotor bears adjacent the screen inlet side cleaning elements which move through the fibrous suspension to be sorted and are designed such that they generate positive pressure surges in the fibrous suspension on their leading side and negative pressure surges on their rear side which, again, bring about flows flushing through and flushing back through the screen apertures. In some of the known pressure sorters according to the publications cited in the aforesaid, measures have been taken in addition to generate turbulences in the fibrous suspension to be sorted at the screen inlet side. These turbulences are intended to prevent the formation of a fibrous fleece in the fibrous suspension to be sorted at the inlet side of the screen. For this purpose, the known cited pressure sorters are provided at the screen inlet side with strips placed on the screen or grooves worked into the screen which extend parallel to the rotor axis, or recesses are worked into the screen wall at the screen inlet side in the region of the screen apertures. This unevenness at the screen inlet side generates the desired turbulences in the fibrous suspension to be sorted since the fibrous suspension to be sorted flows helically along at the screen inlet side as a result of the rotating rotor. These turbulences counteract the formation of any fibrous fleece and they also have the effect that the circulating fibrous suspension which has been thickened to a great extent at the screen inlet side due to fractionation is broken up such that a larger portion of the usable fibers can pass through the screen apertures. Screens having strips placed thereon or grooves worked therein are, however, subject to quite considerable great wear and tear, above all during sorting of fibrous suspensions recovered from mixed waste paper or the like which contain a considerable proportion of solid impurities which lead to rapid wear and tear on the edges of the strips and grooves. Moreover, these screens are expensive to manufacture. This also applies for screens, in which recesses are worked into the screen wall in the region of the screen apertures from the side of the screen inlet.

It is obvious that these comments also apply for those pressure sorters in which the screen is caused to rotate and the cleaning elements are stationary.

The rotors of the known pressure sorters have either a set of arms attached to a central rotor shaft and strip-like cleaning vanes as cleaning elements, which are attached to the outer ends of these arms, or the rotor has a circular-cylindrical casing with cleaning elements attached to the side facing the screen, these cleaning elements having, like the strip-like cleaning vanes mentioned above, a profile which is in cross section transverse to the rotor axis similar to an airfoil. In the latter case, the cleaning elements can also be strip-like cleaning vanes. However, rotors having a circular-cylindrical casing are also known, to which short vane pieces are attached as cleaning elements to avoid pulsations in the fibrous suspension containing usable fibers, the so-called accepted material, leaving the pressure sorter.

SUMMARY OF THE INVENTION

The present invention relates to a novel cleaning vane for pressure sorters of this type and the object underlying the invention was to provide cleaning vanes, with which a high throughput capacity can be achieved for a pressure sorter without having to use a screen which is expensive to produce and susceptible to wear and tear. The throughput capacity is to be understood as that amount of fibrous suspension which passes through the screen apertures per unit of time and per unit of area of the screen.

In a rotor for pressure sorters for sorting fibrous suspensions, which has a plurality of cleaning vanes provided for rotation along the inlet side of the pressure sorter screen and extending transversely to the direction of isolation and approximately parallel to the screen inlet side, these vanes having in cross section transverse to the rotor axis a profile similar to an airfoil, the object of the invention may be accomplished in that at least some of the cleaning vanes have at least regions (return regions) having a profile at the leading side designed as an approximately acute angle—pointing in the direction of rotation towards the screen inlet side—with a first side facing the screen and a second side facing away from the screen for urging the fibrous suspension away from the screen, the second side forming an obtuse angle with the direction of circulation and the first side extending approximately parallel to the direction of rotation or forming herewith an acute angle opening opposite to the direction of rotation. An inventively designed rotor may have self-supporting, strip-like cleaning vanes, of which all or some are designed according to the invention. An inventive cleaning vane can be provided throughout or only in sections with an inventively designed return region. A rotor constructed according to the invention can, however, also have a rotationally symmetrical casing, the side of which facing the screen is provided with inventive cleaning vanes for which the same applies as for the self-supporting cleaning vanes described above and designed according to the invention. Short vane pieces can also be placed on the rotor casing and all or some of these be designed according to the invention.

An inventively designed return region of a cleaning vane causes the ring of fibrous suspension (which is formed at the screen inlet side due to fractionation, circulates at a lower speed than the rotor and has a higher substance density) to be moved away from the screen so that it mixes at a radial distance from the screen with fibrous suspension having a lower substance density before this part of the fibrous suspension again reaches the screen. With correspondingly constructed, inventive cleaning vanes it is possible not only to generate the positive and negative pressure surges in the fibrous suspension to be sorted, which cause the screen apertures to be flushed and reflushed, but also to prevent fiber conglomerates, in particular the formation of a fibrous fleece or mat at the inlet side of the screen due to the inventively designed return regions because the thickened portion of the fibrous suspension to be sorted which forms in front of the screen inlet side is always being urged away from the screen, thinned by mixing with fresh fibrous suspension and then conveyed back to the screen. When using an inventive rotor it is not, therefore, necessary to use a screen with an inlet side which is provided with strips, grooves or other recesses and so the problems of cost and wear and tear connected with such screens can be avoided.

The portions of fibrous suspension urged away from the screen inlet side by the inventive return regions can be fed back to the screen inlet side due to the pressure gradient between the inlet of the pressure sorter for the fibrous suspension to be sorted and the outlet of the pressure sorter. However, in an advantageous development of the inventive rotor, some of the cleaning vanes have at least regions (supply regions) arranged relative to the return regions such that the fibrous, suspension urged away from the screen by the return regions impinges on these supply regions which have, in cross section transverse to the rotor axis, on their leading side a first side facing the screen and forming an acute angle with the direction of circulation. Whereas at the leading side of the return region shape of the first side prevents the fibrous suspension portions adjacent the screen inlet side from being urged against the screen by the return regions, and these fibrous suspension portions are, rather, urged away from the screen inlet side by the second side of the return regions, the first side of the supply regions has the effect that the fibrous suspension portions previously urged away from the screen inlet side are, after being mixed with fresh fibrous suspension, returned to the screen inlet side when the cleaning vanes pass through the fibrous suspension to be sorted since the sides of the supply regions, which face the screen and are located on the leading side of these supply regions, form with the screen an intake gap for the fibrous suspension which tapers opposite to the direction of circulation.

If an inventive rotor has self-supporting cleaning vanes or strip-like cleaning vanes placed on a rotor casing, some of these cleaning vanes can be designed throughout or in sections such that the inventive supply regions are formed hereby. It would, therefore, be possible in the case of, for example, strip-like cleaning vanes to construct successive cleaning vanes in the direction of circulation alternatingly as return regions and supply regions, and over the entire length of the relevant cleaning vane. In the case of a rotor having a rotationally symmetrical casing and relatively short vane pieces placed thereon, a certain number of vane pieces will be constructed as return regions and others as supply regions although it would, of course, also be conceivable to construct a vane piece as return region over part of its length and as supply region over another part of its length.

As already mentioned, in the pressure sorters in question the fibrous suspension to be sorted is fed to the rotationally symmetrical screen from one end thereof so that the suspension flows helically along the screen inlet side from the inflow end of the screen to its other end as a result of relative rotation between screen and rotor. In order to transport that part of the fibrous suspension to be sorted which cannot pass through the screen apertures, namely the so-called rejected material, more quickly to the discharge end of the screen in the direction towards the rejected material outlet of the pressure sorter, it is already known for the cleaning vanes of a rotor—when seen in the direction of the rotor axis from the inlet end of the screen to the other screen end—to form with the rotor axis such an acute angle that the ends of the cleaning vanes facing the inlet end of the screen lead their other ends in the direction of rotor circulation. This measure is also recommended for the inventive rotor. A second advantage is then achieved, namely that that part of the fibrous suspension urged away from the screen by the return regions reaches the supply regions of the cleaning vanes and is thus fed back to the screen inlet side in a thinned or loosened form. It is obvious from the above that reference can also be made to the inlet end of the rotor instead of to the inlet end of the screen.

In order to ensure that fibrous suspension urged away from the screen by the return regions does not again impinge on return regions of the rotor, it is recommended in addition that the rotor be designed such that successive return regions in the direction of circulation are arranged to be offset relative to one another in the direction of the rotor axis. In the case of a rotor also having supply regions it is, consequently, also of advantage for the successive supply regions in the direction of circulation to be arranged to be offset relative to one another in the direction of the rotor axis. If, in this case, as in a preferred embodiment of the inventive rotor, return regions and supply regions are arranged relative to one another such that—when seen in the direction of circulation—return regions and supply regions alternatingly follow one another, the helical flow of the fibrous suspension to be sorted along the screen inlet side results in the suspension, which has been urged away from the screen inlet side by a return region, first impinging on a supply region, particularly when the length of the return regions and the supply regions measured in the direction of the rotor axis is identical and the amount by which these regions are offset is equal to this length.

Advantageously, the first side of the return regions facing the screen extends approximately parallel to the direction of circulation although this side can also form with the direction of circulation an acute angle opening towards the rear. The first embodiment mentioned is more advantageous because this first side does not then cause any drop in pressure in the fibrous suspension adjacent the screen inlet side immediately behind the leading edge of a return region; this drop in pressure would counteract the urging away of the fibrous suspension from the screen inlet side by the second profile side of the return region.

In order to feed that part of the fibrous suspension urged away from the screen inlet side by a return region as completely as possible to a supply region (due to the helical flow path of the fibrous suspension or the inclination of the cleaning vanes relative to the rotor axis), a rotor is recommended which has an outer surface facing the screen and designed to be rotationally symmetrical, the cleaning vanes being placed thereon, whereby the approximately acute-angled profile portion of the return regions is radially spaced from the rotor outer surface such that the return region, together with its acute-angled profile portion and the rotor outer surface, forms a channel extending transversely to the direction of circulation. When, as in other parts of the specification and the claims, an extension transversely to the direction of circulation is specified, this is not intended to be understood only as an angle of 90° since this angle may deviate more or less from a right angle according to the inclination of the cleaning vanes relative to the rotor axis and the pitch of the helical flow path of the fibrous suspension to be sorted.

The inventive measures have a particularly advantageous effect when the portions of the fibrous suspension to be sorted which are urged away from the screen by the return regions are fed back again to the screen inlet side under the influence of centrifugal forces, i.e. when the inventive rotor is provided adjacent the inner side of the screen for circulation. This means that in preferred embodiments of the inventive rotor the first sides of the cleaning vanes are located on the outer side of the rotor.

In order to achieve a practicable flushing back effect for the screen apertures with the inventive cleaning vanes, as well, an inventive embodiment is recommended in which the profile of the cleaning vanes has, downstream of the first side in the direction of circulation, a third side facing the screen and forming with the direction of circulation an acute angle opening towards the rear.

With regard to the flow components of the fibrous suspension to be sorted which are directed from the inlet end to the outlet end of the screen or rotor, it is advantageous for the return regions to have adjacent the first side in the direction of the rotor axis an inclined side surface facing the inlet end of the screen or rotor and forming an impinging surface for a flow directed from the inlet end in the direction of the rotor axis, this surface sloping upwards in the direction towards the screen.

As already mentioned, rotors which have offset, short vane pieces are recommended for breast box installations for avoiding pulsations in the breast box. For material treatment installations and for fibrous suspensions having a high substance density inventive rotors are recommended in which at least some of the cleaning vanes, preferably all the cleaning vanes, are designed as strips extending transversely to the direction of circulation and approximately parallel to the screen inlet side, return and supply regions alternatingly succeeding one another along said strips. This enables particularly intensive turbulences to be generated in the fibrous suspension to be sorted.

In the case of rotors of this type having strip-like cleaning vanes it is advantageous for the strips—when seen in the direction of the rotor axis—to form an angle of between approximately 5° and approximately 45° with the rotor axis. Since the substance density of the fibrous suspension to be sorted increases as its passes from the inlet end to the outlet end of the screen and it is of advantage for that part of the fibrous suspension, in which impurities have accumulated, to be conveyed relatively quickly to the outlet end of the screen, in a preferred embodiment of a rotor provided with strip-like cleaning vanes the strips form over a greater portion of their length, which faces the inlet end of the screen and preferably amounts to approximately ⅔ of the length of the cleaning vanes, a smaller lead angle relative to line parallel to the rotor axis than the remaining, shorter portion of these strips. Expressed the other way around, this means that the shorter portions of the strips facing the outlet end of the screen form a larger lead rotation to line parallel to angle the rotor axis.

BRIEF DESCRIPTION OF THE DRAWINGS

Additional features, advantages and details of the invention result from the following description and the attached drawings of two particularly preferred embodiments of the inventive rotor or rather of pressure sorters comprising an inventive rotor. In the drawings.

DETAILED DESCRIPTION OF THE INVENTION

Figure 1:
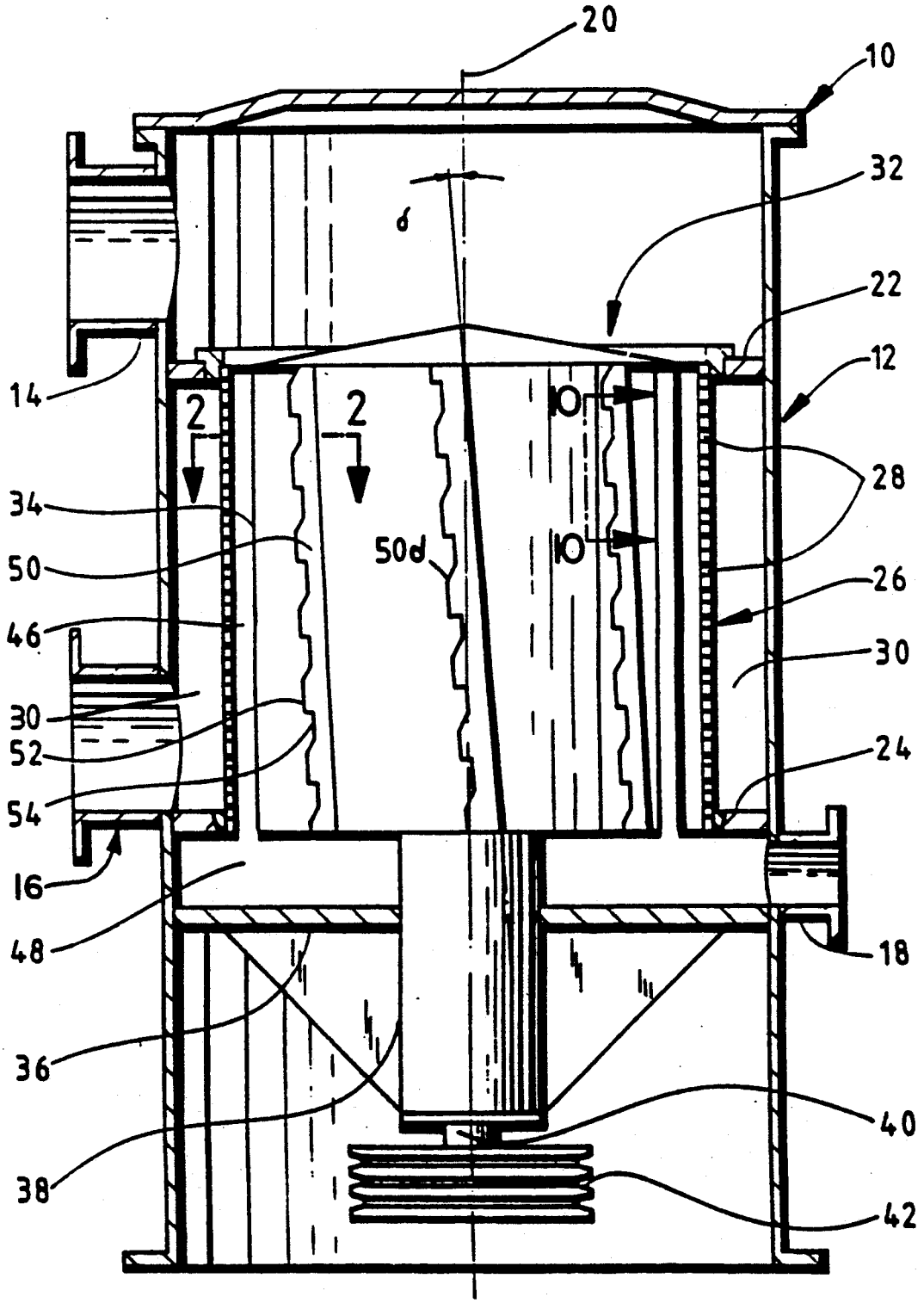
FIG. 1 shows a first pressure sorter comprising a first embodiment of the inventive rotor, in a vertical section through the rotor axis.

The pressure sorter 10 illustrated in FIG. 1 has a housing 12 comprising an inlet pipe 14 for the fibrous suspension to be sorted, an outlet pipe 16 for the so-called accepted material, i.e. that part of the fibrous suspension which has passed through the screen of the pressure sorter and contains the usable fibers, as well as an outlet pipe 18 for the so-called rejected material, namely that part of the fibrous suspension which is held back by the screen of the pressure sorter and contains the impurities as well as fiber conglomerates. Two circular partition walls 22 and 24 which bear a screen cylinder 26 are secured in the housing 12 which, with the exception of the pipes 14, 16 and 18, is designed to be rotationally symmetrical, in particular circular cylindrical, relative to an axis 20. The screen cylinder has a plurality of screen apertures 28 and forms with the housing 12 an outer annular chamber 30, the so-called accepted material chamber, between the partition walls 22 and 24. A rotor 32 is arranged within the screen cylinder 26. This rotor has, in the illustrated embodiment, a closed, circular- cylindrical rotor casing 34 and its axis, like the axis of the screen cylinder 26, coincides with the axis 20 of the housing 12. A housing base 36 is secured in the housing 12 beneath the rejected material outlet pipe 18. This base mounts a bearing 38 for a rotor shaft 40, to which the rotor 32 is secured in a manner not illustrated and which can be drive by means of a belt pulley 42 secured to the rotor shaft. The direction of rotation or circulation of the rotor 32 is indicated in FIG. 1 by the arrow R. Since the external diameter of the rotor casing 34 is somewhat smaller than the internal diameter of the screen cylinder 26, these two elements of the pressure sorter 10 form an inner annular chamber 46, in which the fibrous suspension to be sorted flows helically from top to bottom. The part of the fibrous suspension retained by the screen cylinder 26 passes into the rejected material chamber 48 beneath the rotor 32 and above the housing base 36, into which the rejected material outlet pipe 18 opens.

On the outside of the rotor casing 34, a plurality of strip-like cleaning vanes 50 are secured at equal distances from one another in the direction of circulation R. When seen in the side view vertically to the axis 20, these vanes form with this axis an acute angle $\delta$ which is preferably between approximately 5° and approximately 45° and may vary along the rotor casing 34 from top to bottom, i.e. the cleaning vanes 50 need not have the shape of straight strips. As clearly shown in FIG. 1, the cleaning vanes 50 form alternatingly successive return regions 52 and supply regions 54 in the longitudinal direction of the strip and these regions will be described in more detail in the following.

The fibrous suspension to be sorted in the pressure sorter 10 is fed into the inlet pipe 14 under pressure and, as the rotor is closed at the top, flows from above into the inner annular chamber of the pressure sorter 10. Due to rotation of the rotor 32, the fibrous suspension to be sorted flows helically through the inner annular chamber 46 from top to bottom. The part of the fibrous suspension containing the individual, usable fibers passes through the screen apertures 28 into the accepted material chamber 30 and leaves the pressure sorter 10 via the accepted material outlet pipe 16. The part of the fibrous suspension retained by the screen cylinder 26, namely the rejected material, leaves the pressure sorter via the rejected material chamber 48 and the rejected material outlet pipe 18.

The inventive construction of the cleaning vanes 50 will now be explained in greater detail on the basis of FIGS. 2 to 4, 8, 9 and 10.

Each of the return regions 52 has at the front in the direction of circulation R an acute-angled profile portion 52*a* having a first side 52*b* facing the screen cylinder 26 and a second side 52*c* facing away from the screen cylinder. The first side 52*b* extends approximately parallel to the screen cylinder 26 or to the direction of circulation R, whereby it is possible, however, to have a small acute angle between the first side 52*b* and the direction of circulation R which opens to the rear. The second side 52*c* forms an obtuse angle $\alpha$ with the direction of circulation R and merges in the direction towards the rotor axis 34 into a wall 52*e* which, in cross section vertical to the rotor axis 20, extends approximately radially so that each return region 52 with its second side 52*c* and its radially extending wall forms with the rotor casing 34 a channel 56 extending approximately transverse to the direction of circulation R.

Each of the supply regions 54 has at the front in the direction of circulation R a first side 54*b* which, in cross section normal to the rotor axis 20, forms with the direction of circulation R an acute angle $\beta$ opening towards the front.

On their rear sides the return regions 52 and the supply regions 54 have third sides 52*d* and 54*d*, respectively, which are aligned with one another and form with the direction of circulation R an acute angle $\gamma$ opening towards the rear.

Figure 2:
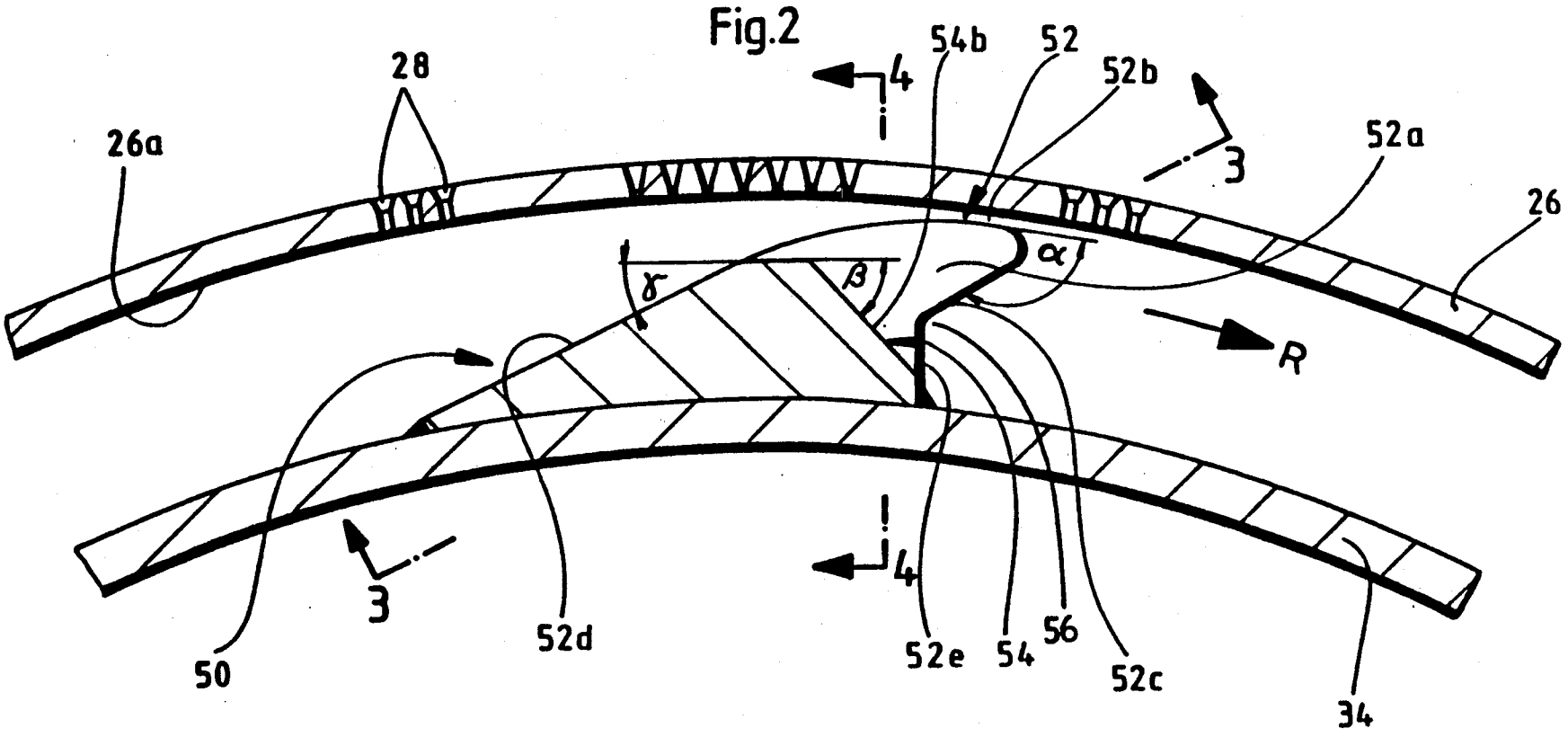
FIG. 2 shows a section along line 2—2 in FIG. 1 through a section of the screen of the pressure sorter and the rotor.
Figure 3:
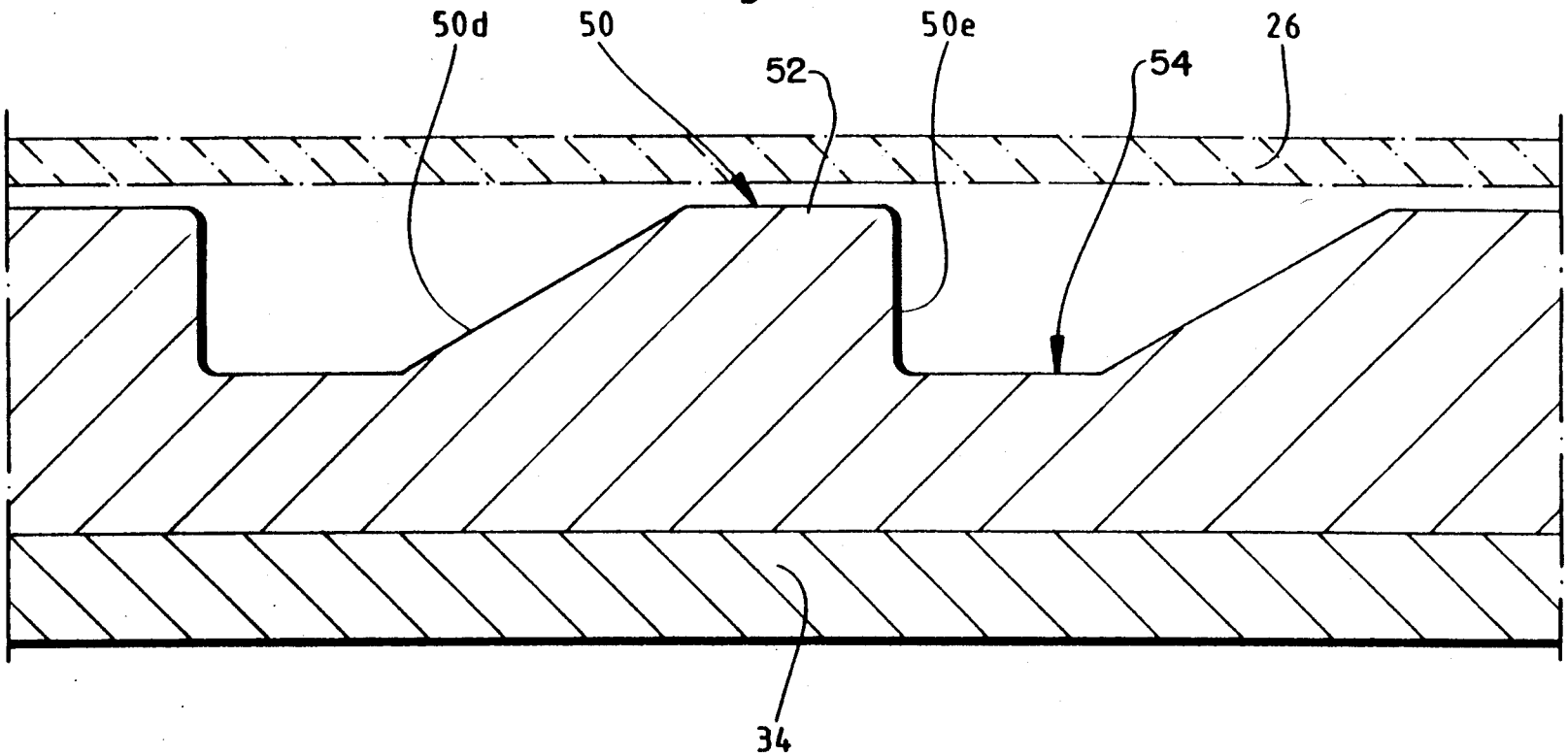
FIG. 3 shows a section along line 3—3 in FIG. 2.
Figure 4:
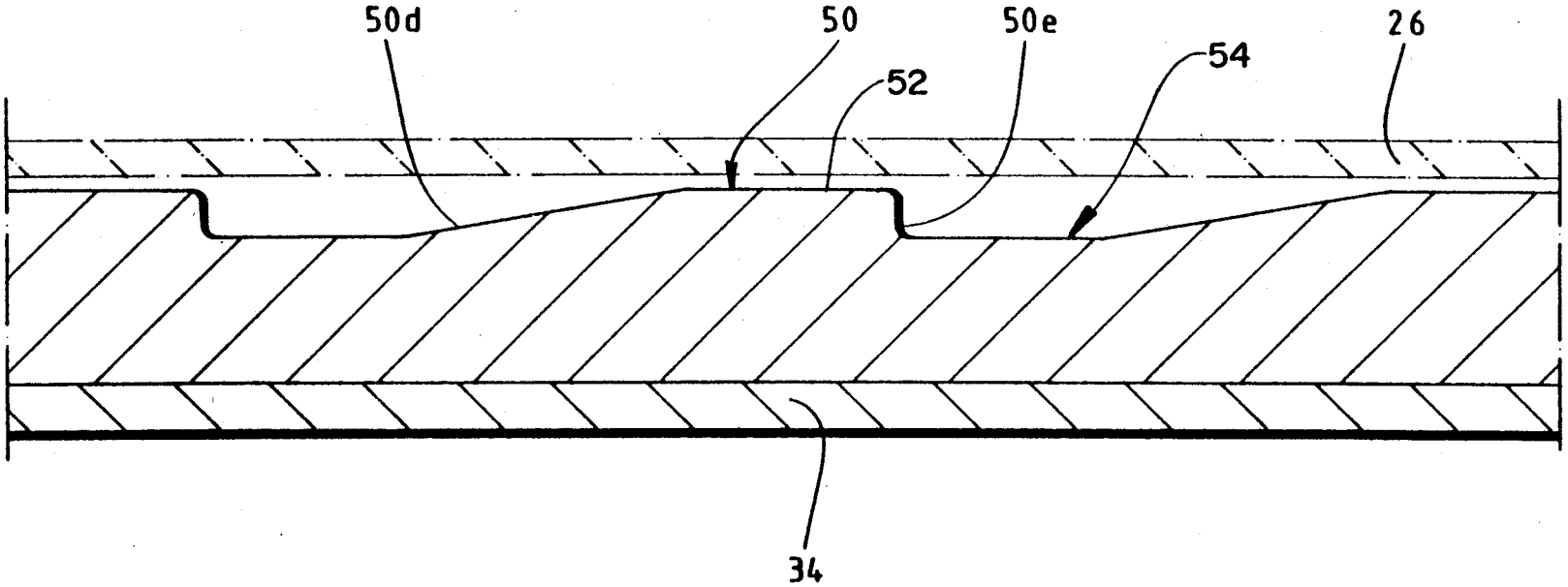
FIG. 4 shows a section along line 4—4 in FIG. 2.

For the sake of simplicity, only a few screen apertures 28 have been depicted in FIG. 2. However, it goes without saying that the screen cylinder 26 is provided overall with this type of screen aperture. For the sake of completeness, the inlet side of the screen cylinder 26 has been designated in FIG. 2 as 26*a*, i.e. the accepted material passes through the screen apertures 28 in radial direction from the inside to the outside.

The revolving rotor 32 with its cleaning vanes 50 has the effect that these vanes generate positive and negative pressure surges in the fibrous suspension to be sorted; positive pressure surges result in the fibrous suspension upstream of the cleaning vanes 50 in the direction of circulation R and negative pressure surges in the region of the third sides 52*d* and 54*d*, respectively. The positive pressure surges occurring upstream of the cleaning vanes force an increased throughput through the screen apertures 28 whereas the negative pressure surges occurring in the region of the inclined sides 52*d* and 54*d*, respectively, have a flushing back effect at the screen apertures 28. Due to the acute-angled profile parts 52*a* of the return regions 52 which revolve at a very small distance from the inlet side 26*a* of the screen cylinder 26, that part of the fibrous suspension immediately adjacent the screen inlet side 26*a* is urged or diverted away from the screen cylinder 26, thanks to the second sides 52*c* of the return regions 52 which are inclined rearwards and radially inwards. The suspension portions thickened due to the effect of the screen apertures 28 are therefore conveyed radially inwards into regions in which the fibrous suspension to be sorted has a lower substance density. Due to the inclination of the cleaning vanes 50 relative to the rotor axis 20 through an angle $\beta$, as illustrated in FIG. 1, the thickened fibrous suspension is conveyed in the channels 56 along the relevant cleaning vane, according to FIG. 1 downwards, to the relevant adjacent supply region 54 and again fed to the screen inlet side 26*a* by the first side 54*b* of the supply region. Since the first side 54*b* is inclined through an angle $\beta$, this portion of the fibrous suspension which is diverted towards the screen inlet side meets portions of the fibrous suspension flowing in the direction of circulation R in the vicinity of the screen cylinder 26 as a result of the revolving cleaning vanes 50. This results not only in a mixing of those fibrous suspension portions circulating in direction R in the vicinity of the screen inlet side 26*a* with the fibrous suspension portions diverted along the inlet side 26*a* but also in relatively strong turbulences due to the almost oppositely directed flows and these turbulences prevent the formation of a fibrous fleece in the vicinity of the screen inlet side 26*a*.

The inventive construction of the cleaning vanes 50 therefore leads to flushing and flushing back pulses at the screen apertures 28, it counteracts the formation of thickened fibrous suspension portions in the vicinity of the screen inlet side 26a and, finally, it causes turbulences in the region of the screen inlet side 26a which counteract the formation of a fibrous fleece.

As already mentioned, the fibrous suspension to be sorted flows helically through the inner annular chamber 46 from top to bottom and, consequently, has a flow component directed downwards, which is not intended to counteract the rotor with its cleaning vanes 50. For this reason, the return regions 52 are, finally, provided at the top (cf. FIGS. 3 and 4) with inclined side faces 50d which resist the flow component of the fibrous suspension in the inner annular chamber 46, which is directed from top to bottom, to a lesser degree than if the return regions 52 of the cleaning vanes 50 were provided on both sides with side faces which extend approximately normal to the rotor axis 20, as is the case with the lower side faces 50e.

The strips 50 may be formed of any suitable material by any appropriate forming and shaping technique. In one example the strips 50 may be made from stainless steel and their overall outer profile obtained by drawing a bar of the stainless steel through an appropriate die. The strips may then be machine to provide the areas of reduced cross section and respective surfaces, such as surfaces 54b, 50d and 54f.

As already mentioned, the cleaning vanes, 50 need not have, overall, the same inclination $\delta$ relative to the rotor axis 20, as shown in the case of the cleaning vanes illustrated in FIG. 1. In an inventive modification which has not been shown in the drawings the lower third of the cleaning vanes 50 is inclined to a greater extent relative to the rotor axis 20 than the upper two thirds of the cleaning vanes 50, i.e. the strip-like cleaning vanes are, in this variation, bent. In this way, a stronger, downwardly directed conveying effect of the cleaning vanes will result in the lower third of the rotor and this causes the rejected material in the lower third of the screen cylinder 26, which is already thickened to a considerable degree, to be more rapidly urged away into the rejected material chamber 48.

In a further variation of the pressure sorter according to FIGS. 1 to 4, which is not illustrated in the drawings, the cleaning vanes 50 are broken up into individual, short vane pieces corresponding to the return regions 52 and the supply regions 54 and these vane pieces are distributed more or less equally around the circumference of the rotor casing 34. In this embodiment, the return regions 52 would be arranged at the same places on the rotor casing as the return regions 54 of the strip-like cleaning vanes 50, and the supply regions 52 would be arranged between the cleaning vanes 50 in the direction of circulation R.

In all these variations, and also in the embodiment illustrated in FIGS. 1 to 4, the return regions 52, on the one hand, and the supply regions 54, on the other, of successive cleaning vanes in the direction of circulation R are, as clearly shown in FIG. 1, offset relative to one another in the direction of the rotor axis 20 by the width of a region, i.e. in the direction of circulation R a return region 52 is followed by a supply region 54.

Figure 5:
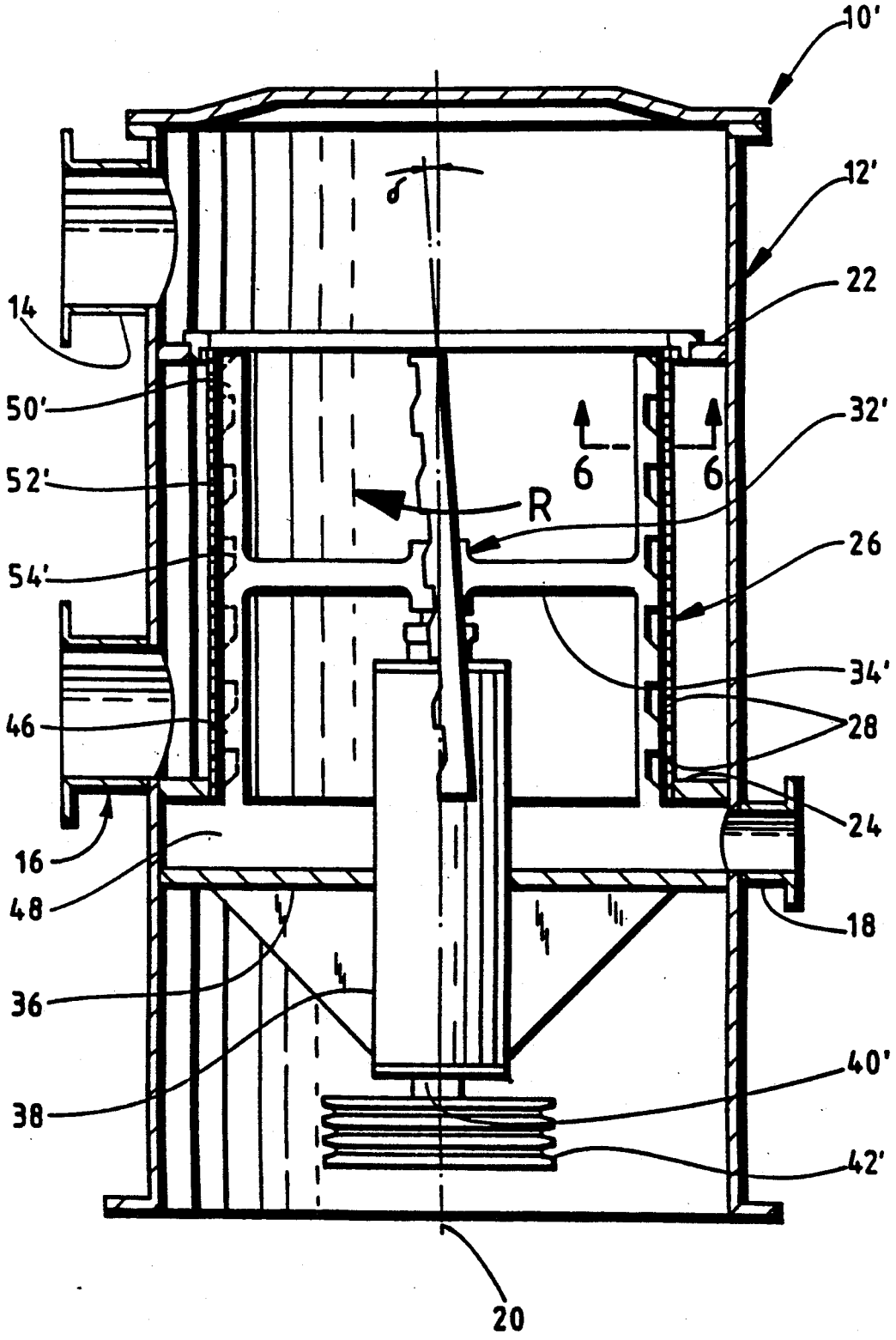
FIG. 5 shows a sectional illustration corresponding to FIG. 1 through a second pressure sorter comprising a second embodiment of the inventive rotor.
Figure 6:
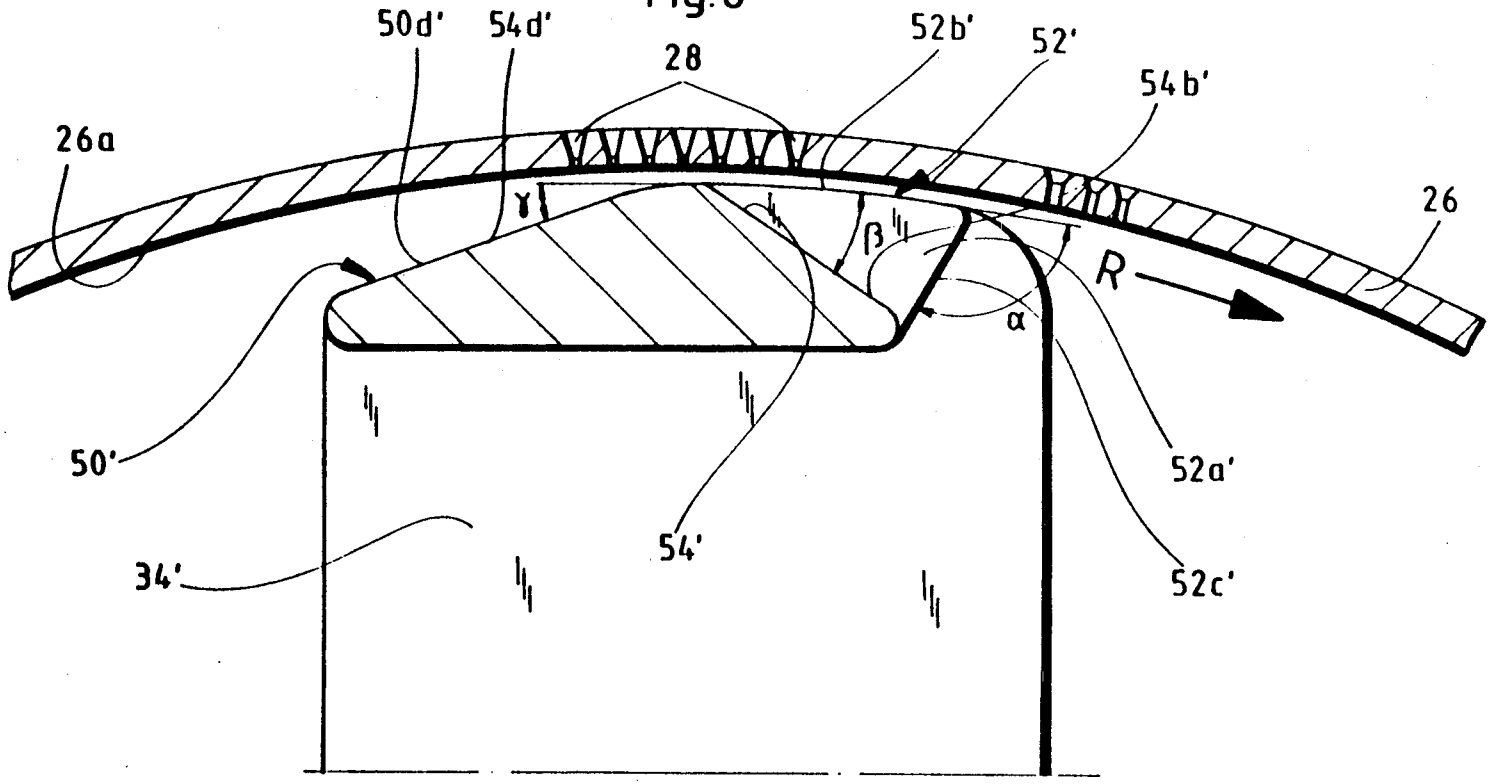
FIG. 6 shows a section corresponding to FIG. 2 along line 6—6 in FIG. 5 through part of the screen and the rotor.
Figure 7:
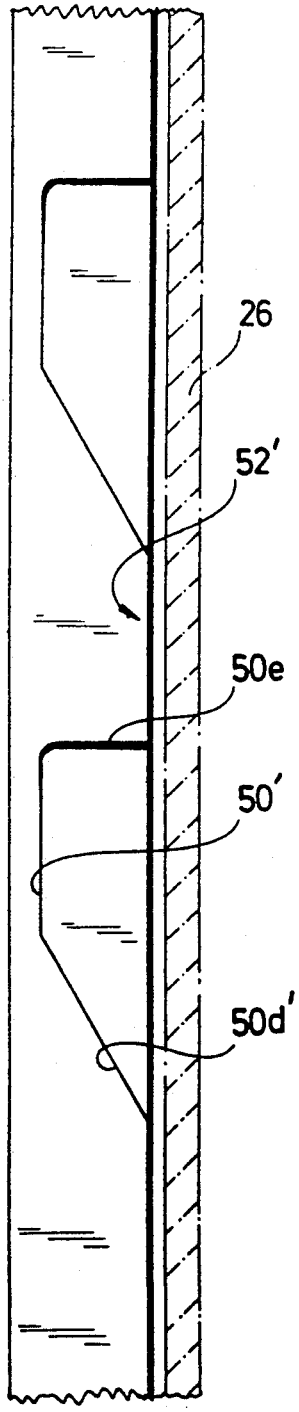
FIG. 7 is a view of the rotor part shown in FIG. 6, seen in the direction of arrow "A" in FIG. 6, with the screen indicated by dash-dot lines.
Figure 8:
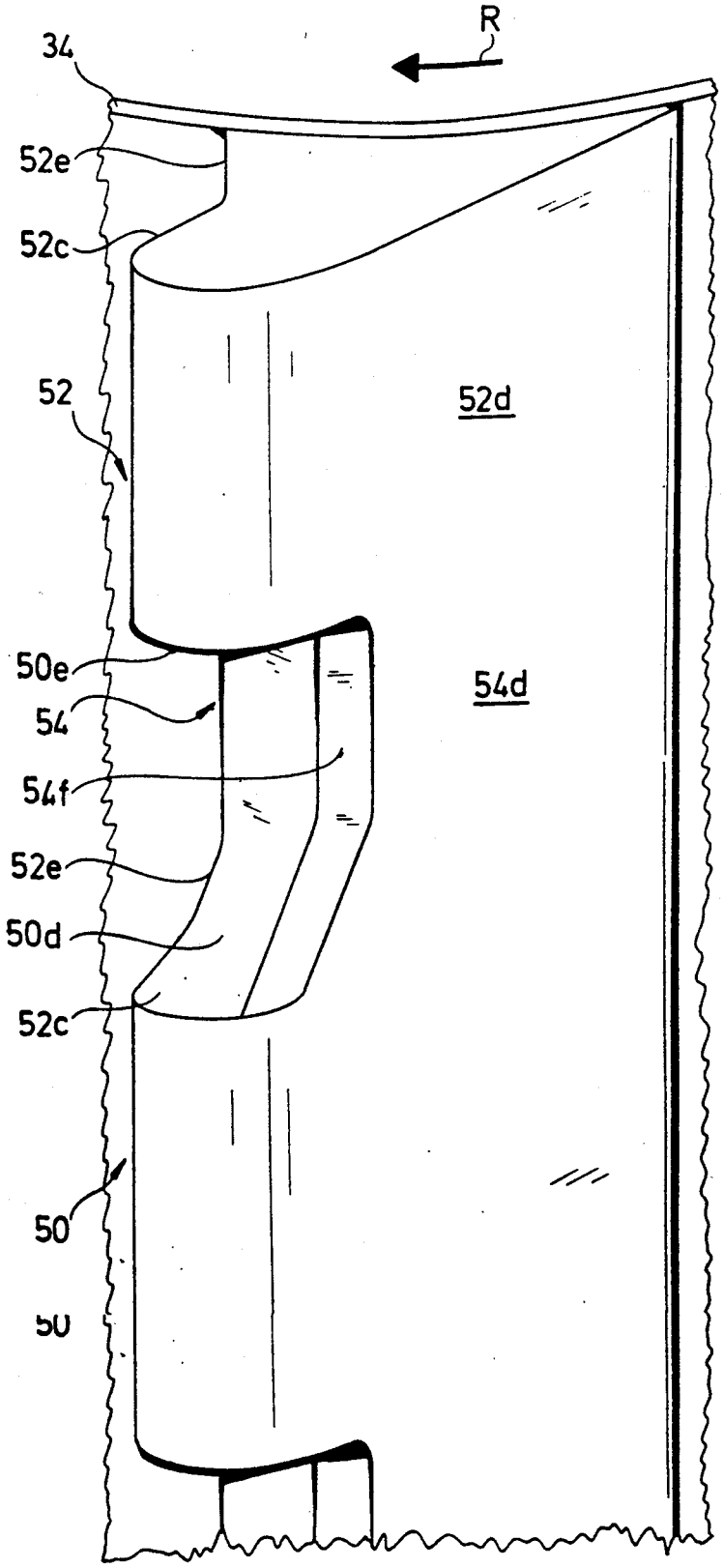
FIG. 8 is a perspective view of the upper portion of the vane 50 generally as shown in FIG. 1 on the left of the rotor 32.
Figure 9:
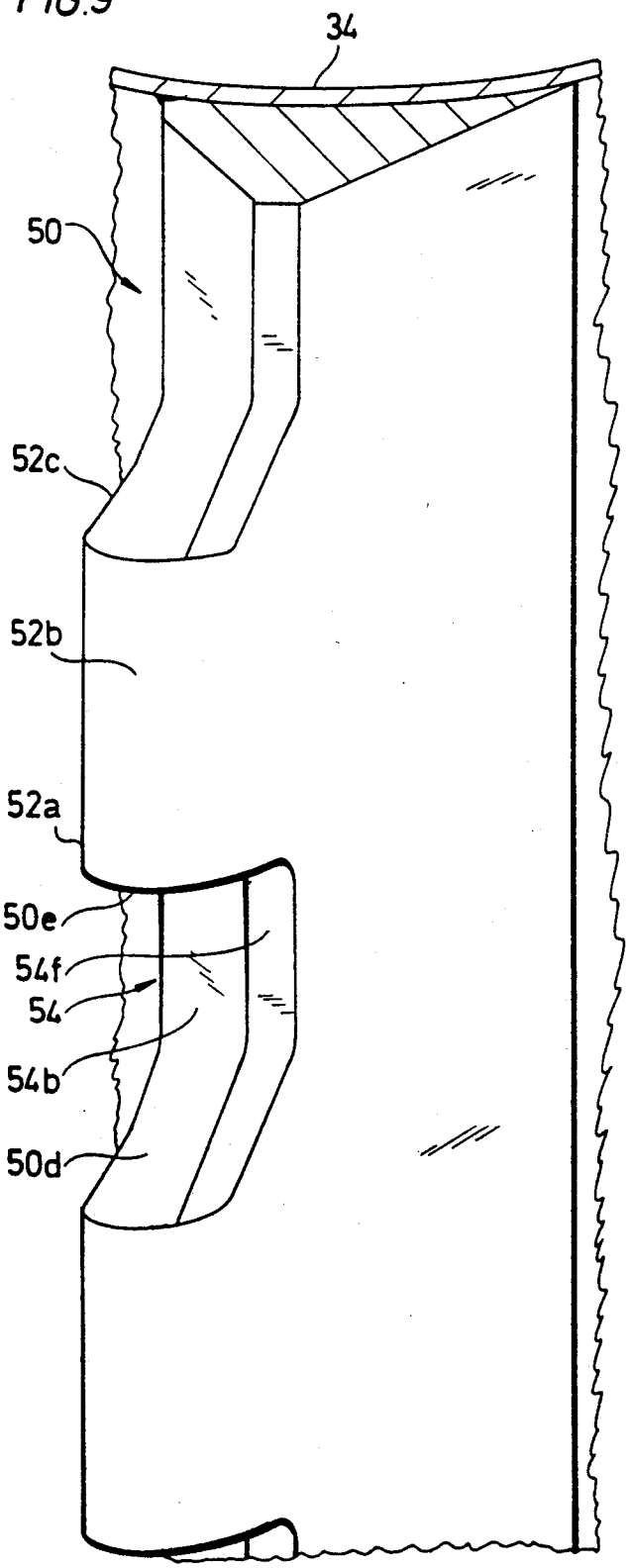
FIG. 9 shows a perspective view of the upper portion of the vane shown in FIG. 1 in front of the axis 20 of the rotor.
Figure 10:
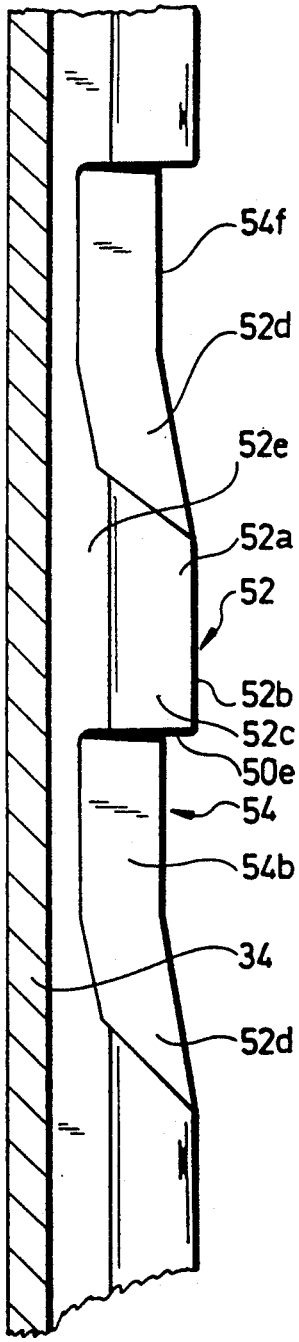
FIG. 10 is a sectional view of a portion of the upper right corner area of the rotor 32 as shown in FIG. 1 with a front view of one of the vanes, generally along line 10—10 of FIG. 1.

In the embodiment illustrated in FIGS. 5 to 7, the rotor is designed as an open structure, i.e. it has no rotor casing, and the cleaning vanes are connected with the rotor shaft via radially extending supporting arms. Otherwise, the pressure sorter of FIGS. 5 to 7 is designed in the same manner as the pressure sorter of FIGS. 1 to 4 and so the same reference numerals as those according to FIGS. 1 to 4 have been used for corresponding parts, with an apostrophe added. It should therefore also be sufficient to merely explain in the following the design of the rotor of the pressure sorter according to FIGS. 5 to 7.

The rotor 32' of the pressure sorter 10' shown in FIGS. 5 to 7 has arms 34' attached to the rotor shaft 40' in a star formation, i.e. they extend radially, and a cleaning vane 50' is secured to each of these arms. These cleaning vanes are again of a strip-like design and return regions 52' and supply regions 54' follow each other alternatingly along each of these cleaning vanes. As is particularly apparent from FIG. 6, the return regions 52' again have a profile part 52a' which forms an acute angle in cross section and has a first side 52b' extending approximately parallel to the direction of circulation R and a second side 52c' forming an obtuse angle $\alpha$ with the direction of circulation R. The adjacent supply regions 54' have on their inflow side a first side 54b' facing the screen inlet side 26a and forming an acute angle 62 with the direction of circulation R. The backs of the return regions 52' and the supply regions 54' are formed by third sides 52d' and 54d', respectively, which form with the direction of circulation R an acute angle $\gamma$ opening to the rear.

In this embodiment, as well, the fibrous suspension portions adjacent the screen inlet side 26a are urged away from the screen inlet side inwards in radial direction by the second sides 52c' of the return regions 52 and after mixing with fibrous suspension portions having a lower substance density diverted by the first sides 54b' of the supply regions 54' back towards the screen inlet side 26a so that the desired turbulence result. With the exception of the function of channels 56 of the embodiment according to FIGS. 1 to 4, the cleaning vanes 50' result in the same effects as the cleaning vanes 50.

What is claimed is:

1. A method for sorting a fibrous suspension in a pressure sorter having a rotationally symmetrical screen with an inlet side and an outlet side and a plurality of cleaning vanes arranged in close proximity to said inlet side of said screen and extending approximately parallel to said inlet side, wherein there is relative rotational movement between the screen and said cleaning vanes about a central axis of said screen, the improvement comprising the steps of (a) urging first portions of the suspension away from the inlet side of said screen by first sections of said vanes;

(b) mixing said first portions with fresh suspension to be sorted thereby obtaining a mixture;

(c) directing said mixture to second sections of said vanes; and (d) returning said mixture to the screen inlet side by said second vane sections.

2. A pressure sorter for sorting fibrous suspensions and comprising:

a housing;

a rotationally symmetrical screen mounted in said housing, said screen having an inlet side, an outlet side and a screen axis, and defining an inlet chamber adjacent said inlet side having first and second axial end regions, and an accept stock chamber adjacent said outlet side;

a rotor mounted in said housing for rotation about said screen axis, said rotor having a circumferential wall being rotationally symmetrical to said screen axis and facing the inlet side of the screen;

an inlet to said housing in communication with the first axial end region of said inlet chamber for feeding a suspension to be sorted into said inlet chamber;

an accepted stock outlet from said housing in communication with said accepted stock chamber;

a rejects outlet from said housing in communication with the second axial end region of said inlet chamber;

said rotor having means for circulating and advancing said suspension between the inlet side of the screen and the circumferential wall of the rotor in a circumferential direction about said screen axis and in the axial direction of said axis along a helical flow path from said first axial end region toward said second axial end region of said inlet chamber;

a plurality of cleaning vanes mounted on the circumferential wall of said rotor for rotation in close proximity to the inlet side of said screen, at least some of said cleaning vanes having first sections which in cross section transverse to the screen axis are similar to an airfoil with a leading edge portion facing in the direction of rotation for producing positive pressure pulses in the suspension within said inlet chamber and with a trailing edge portion facing in the opposite direction for producing negative pressure pulses in the suspension within said inlet chamber, said cleaning vanes extending transversely to the direction of rotation of said rotor and approximately parallel to the inlet side of the screen;

wherein at least some of said first cleaning vane sections have at said leading edge portion a wedge-shaped profile in cross-section approximating an acute angle oriented obliquely towards the inlet side of said screen, said profile having a first side facing the screen and a second side forming an obtuse angle with the direction of rotation of said rotor and facing away from said screen for urging suspension away from the inlet side of said screen;

and wherein at least some of said cleaning vanes have second sections disposed relative to said first sections such that the suspension urged away from the inlet side of the screen by said first sections impinges on said second sections, said second sections having a leading edge portion facing in the direction of rotation, said leading edge portion having a first side facing said screen and diverging therefrom at an acute angle in said direction of rotation for urging suspension towards the inlet side of said screen.

3. A pressure sorter for sorting fibrous suspensions and comprising:

a housing;

a rotationally symmetrical screen mounted in said housing, said screen having an inlet side, an outlet side, and a screen axis, and defining an inlet chamber adjacent said inlet side having first and second axial end regions, and an accept stock chamber adjacent said outlet side;

a rotor mounted in said housing for rotation about said screen axis within said inlet chamber;

an inlet to said housing in communication with the first axial end region of said inlet chamber for feeding a suspension to be sorted into said inlet chamber;

an accepted stock outlet from said housing in communication with said accepted stock chamber;

a rejects outlet from said housing in communication with the second axial end region of said inlet chamber;

said rotor having means for circulating and advancing said suspension adjacent the inlet side of the screen in a circumferential direction about said screen axis and in the axial direction of said axis along a helical flow path from said first axial end region toward said second axial end region of said inlet chamber;

said rotor having a plurality of bar-like cleaning vanes arranged for rotation in close proximity to the inlet side of said screen, at least some of said cleaning vanes having first sections which in cross section transverse to the screen axis are similar to an airfoil with a leading edge portion facing in the direction of rotation for producing positive pressure pulses in the suspension within said inlet chamber and with a trailing edge portion facing in the opposite direction for producing negative pressure pulses in the suspension within said inlet chamber, said cleaning vanes extending transversely to the direction of rotation of said rotor and approximately parallel to the inlet side of the screen;

wherein at least some of said first cleaning vane sections have at said leading edge portion a wedge-shaped profile in cross-section approximating an acute angle oriented obliquely towards the inlet side of said screen, said profile having a first side facing the screen and a second side forming an obtuse angle with the direction of rotation of said rotor and facing away from said screen for urging suspension away from the inlet side of said screen;

and wherein at least some of said cleaning vanes have second sections disposed relative to said first sections such that the suspension urged away from the inlet side of the screen by said first sections impinges on said second sections, said second sections having a leading edge portion having a first side facing said screen and diverging therefrom at an acute angle in said direction of rotation for urging suspension towards the inlet side of said screen.

4. A pressure sorter as claimed in claim 2 or 3, wherein successive first sections in the direction of rotation of said rotor are offset relative to one another in the direction of said screen axis.

5. A pressure sorter as claimed in claim 4, wherein the length of said first and second sections measured in the direction of said screen axis is identical and the amount said first and second sections are offset is equal to this length.

6. A pressure sorter as claimed in claim 2 or 3, wherein successive second sections in the direction of rotation of said rotor are offset relative to one another in the direction of said screen axis.

7. A pressure sorter as claimed in claim 6, wherein the length of said first and second sections measured in the direction of said screen axis is identical and the amount said first and second sections are offset is equal to this length.

8. A pressure sorter as claimed in claim 2 or 3, wherein said first side of each of said first sections extends approximately parallel to the inlet side of said screen.

9. A pressure sorter as claimed in claim 2, wherein said leading edge portion of each of said first sections is radially spaced from the circumferential wall of said rotor so that said leading edge portion and said circumferential wall form a channel extending transversely to the direction of rotation of said rotor.

10. A pressure sorter as claimed in claim 2 or 3, wherein said first side of each of said first sections is located on the radially outer side of the respective vane.

11. A pressure sorter as claimed in claim 2 or 3, wherein each of said first and second sections have, rearward of the respective first side relative to the direction of rotation of said rotor, a third side facing the inlet side of said screen and diverging therefrom at an acute angle in a direction opposite to said direction of rotation.

12. A pressure sorter as claimed in claim 2 or 3, wherein said first sections have, adjacent the respective first side and extending in the direction of said screen axis, an inclined surface facing the first axial end region of said inlet chamber and forming an impingement surface for a flow of suspension directed in the direction of said screen axis from said first axial end region toward said second axial end region of the inlet chamber, said impingement surface sloping towards the inlet side of said screen in the direction from said first to said second axial end region of the inlet chamber.

13. A pressure sorter as claimed in claim 2, wherein said cleaning vanes have the form of bars mounted on said circumferential wall of said rotor.

14. A pressure sorter as claimed in claim 3 or 13, wherein each of said cleaning vanes is disposed at an angle of between approximately 5° and approximately 45° to said screen axis.

15. A pressure sorter as claimed in claim 14, wherein said cleaning vanes form over a major portion of their length adjacent the first axial end region of said inlet chamber a smaller angle with said direction than the remaining portion of said cleaning vanes.

16. A pressure sorter as claimed in claim 2 or 3, wherein said first and second sections are arranged in alternating succession relative to one another in the direction of said screen axis.

17. A pressure sorter as claimed in claim 2 or 3, wherein said first and second sections are arranged in alternating succession relative to one another in said direction of rotation.

18. A pressure sorter as claimed in claim 2 or 3, wherein said first and second sections are arranged in alternating succession relative to one another along said helical flow path.

19. A pressure sorter as claimed in claim 2 or 3, wherein at least one of said cleaning vanes includes said first sections and said second sections and said first sections and said second sections thereof are arranged in alternating succession relative to one another along said cleaning vane.

* * * * *

UNITED STATES PATENT AND TRADEMARK OFFICE

CERTIFICATE OF CORRECTION

PATENT NO. : 5,176,261

DATED : January 5, 1993

INVENTOR(S) : Emil Holz

It is certified that error appears in the above-identified patent and that said Letters Patent is hereby corrected as shown below:

Column 1, line 28, after "sorters" delete -- , --.

Column 2, line 42, "isolation" should read -- rotation --.

Column 3, line 17, after "mat" insert -- , --.

Column 3, line 42, "region" should read -- regions the --.

Column 6, line 9, "line" should read -- lines --.

Column 6, line 13, "lead rotation to line parallel to angle the rotor axis" should read -- lead angle relative to lines parallel to the rotor axis --.

Column 8, line 46, "ß" should read -- $\delta$ --.

Column 8, line 60, after "along the" insert -- first sides 54b of the supply regions 54 towards the screen --.

Column 9, line 26, after "vanes" delete -- , --.

Column 9, line 49, "54" should read -- 52 --.

UNITED STATES PATENT AND TRADEMARK OFFICE

CERTIFICATE OF CORRECTION

ATENT NO. : 5,176,261

ATED : January 5, 1993

IVENTOR(S) : Emil Holz

It is certified that error appears in the above-identified patent and that said Letters Patent is hereby orrected as shown below:

Column 9, line 50, "52" should read -- 54 --.

Column 10, line 20, "62" should read -- β --.

Column 10, line 32, "turbulence" should read -- turbulences --.

Column 12, line 39, after "portion" insert -- facing in the direction of rotation, said leading edge portion --.

Signed and Sealed this

Twenty-seventh Day of August, 1996

Bruce Lehman

*Attest:*

BRUCE LEHMAN

*Attesting Officer*

*Commissioner of Patents and Trademarks*